United States Patent [19]

Forterre et al.

[11] Patent Number: 4,698,604

[45] Date of Patent: Oct. 6, 1987

[54] NONRECIPROCAL MICROWAVE DEVICE FOR SURFACE WAVES AND AN ISOLATOR HAVING HIGH ISOLATION FOR THE UTILIZATION OF SAID DEVICE

[75] Inventors: Gérard Forterre, Colombes; Bernard Guerin, Paris, both of France

[73] Assignee: Thomson-CSF, Paris, France

[21] Appl. No.: 813,002

[22] Filed: Dec. 24, 1985

[30] Foreign Application Priority Data

Dec. 27, 1984 [FR] France ..... 84 19923

[51] Int. Cl.[4] ..... H01P 1/37

[52] U.S. Cl. ..... 333/24.2; 333/246

[58] Field of Search ..... 333/24.1, 24.2

[56] References Cited

U.S. PATENT DOCUMENTS 3,617,951 11/1971 Anderson ..... 333/24.2 X
3,886,502 5/1975 Radding et al. .
4,050,038 9/1977 Noguchi et al. .
4,152,677 5/1979 Chiron et al. ..... 333/24.2

FOREIGN PATENT DOCUMENTS 2023812 8/1970 France .
2507391 12/1982 France .

*Primary Examiner*—Paul Gensler
*Attorney, Agent, or Firm*—Oblon, Fisher, Spivak, McClelland & Maier

[57] ABSTRACT

A nonreciprocal microwave device for surface electromagnetic waves (SEW waves) as applicable to isolators which provide high isolation comprises a flat metallic core, part of which is placed between two plates of gyromagnetic material and part of which is placed between two absorption loads. Parasitic volume waves are generated by resonance but resonance of waves of higher modes is prevented by forming in the core at least one zone for strong coupling with the SEW waves which propagate in the direction opposite to the low-loss direction at the edge of the core opposite to the edge at which the SEW wave propagates in the forward direction.

7 Claims, 6 Drawing Figures

NONRECIPROCAL MICROWAVE DEVICE FOR SURFACE WAVES AND AN ISOLATOR HAVING HIGH ISOLATION FOR THE UTILIZATION OF SAID DEVICE

BACKGROUND OF THE INVENTION

1. Field of the Invention

The present invention relates to the microwave field and more particularly to nonreciprocal devices for surface electromagnetic waves without volume waves. The invention is primarily applicable to microwave isolators having low insertion losses in the direction of wave propagation and high attenuation in the reverse direction over a broad frequency range of the order of 4 to 20 GHz.

2. Description of the Prior Art

Surface electromagnetic waves are understood to means waves which propagate in a direction perpendicular to the magnetization of an anisotropic material such as a ferrite and in modes of a noval type designated as abnormal gyromagnetic modes arising from the anisotropic properties of ferrite.

The term nonreciprocal circuit refers to a circuit whose transmission characteristics (attenuation, phase-shift) change according to the direction of wave propagation through the circuit. Known circuits of this type include transmission-line sections (coaxial lines, waveguides, striplines circuits, and so on) which contain ferrimagnetic or gyromagnetic material such as a ferrite which is subjected to a steady magnetization field. The permeability of a material of this type when subjected to external magnetization is a tensor, which means that the impedance of the medium for a wave propagated therein depends on the orientation of the magnetic field of the wave with respect to a fixed reference related to said medium. This orientation therefore changes with the direction of propagation. It is the use of this property that forms a basis for the construction of circuits known as circulators, isolators, phase-shifters and so on, which have the function in the case of isolators, for example, of transmitting waves with low attenuation in the forward direction (a few dB and sometimes lower values) and much higher attenuation in the reverse direction (higher than 20 dB).

For a detailed description of these so-called surface waves, reference can be made for example to the articles published respectively in "Cables and Transmission", No. 4, October 1973, pages 416 to 435, under the title: "Propagation in a magnetized ferrite plate, application to novel wide-band nonreciprocal devices", and in "Transactions on Magnetics" of the Institute of Electrical and Electronic Engineers - Vol. Mag. 11 - No. 5 - September 1975, page 1276.

Furthermore, nonreciprocal microwave devices have known structures which utilize the propagation of electromagnetic surface waves in a medium consisting of a gyromagnetic or ferrimagnetic material. Devices of this type have already been disclosed in published documents, among which may be cited U.S. Pat. No. 3,845,413 in respect on "Nonreciprocal surface-wave devices" as well as U.S. Pat. No. 4,152,677 and relating to "Wide-band isolators for operation at centimeter-wavelengths".

Other modes of surface propagation including parasitic modes of volume waves or surface waves can be excited at frequencies of the waveband to be transmitted and can propagate in the gyromagnetic material simultaneously with the desired nonreciprocal surface mode. The parasitic modes which are closest to the mode employed (this latter being designated as a "dynamic mode") are volume modes. The essential aim of the present invention is to provide means for reducing the proportion of energy applied to the device which undergoes a transformation to a parasitic wave, and which is derived from the energy propagated in the dynamic mode employed.

The devices constructed in accordance with the techniques described in the patents cited in the foregoing sustain parasitic volume modes excited by the electromagnetic surface mode designated as the SEW mode (surface electromagtnetic waves). Up to the present time, no method has yet been found for systematically blocking the process of excitation of these parasitic modes. The main disturbing modes are hybrid modes which are closely related to the TE modes (dominant transverse electric modes).

It is known that, in a device of this type, a flat metallic conductor or so-called core of substantially trapezoidal shape such that the sides which are not parallel to each other are curvilinear is placed between two plates of gyromagnetic material in which the surface waves propagate and two plates forming absorption loads and placed against said plates of gyromagnetic material. This device is subjected to a magnetic field H perpendicular to the plane of the core. In all devices of this type, the surface modes are guided along the bound to the surface of the flat conductor or strip-line, said surface being parallel to the field H. In the forward direction, the surface modes are consequently guided by the long rectilinear side of the trapezoidal core and transmitted to the output of the device. On the other hand, in the reverse direction, the surface modes are guided by the curved portion of the core and absorbed by the absorption loads. Volume modes also exist in the strip-line and penetrate into the absorber.

SUMMARY OF THE INVENTION

It is a primary objective of the invention to prevent the phenomenon of resonance of the higher modes and therefore to prevent the appearance of substantial couplings between the energy transported by these modes. To this end, there is interposed in the resonator in the TE mode a zone providing a strong coupling with the SEW mode which propagates in reverse with respect to the low-loss direction at the edge of the central core opposite to the rectilinear edge which propagates the SEW wave in the forward direction.

From a mechanical or geometric standpoint, this means that the device in accordance with the invention consists of a long rectilinear side parallel to the plates of gyromagnetic material and two nonparallel curvilinear sides, the convexity of which is directed towards the long rectilinear side. However, the short side or straight edge of a trapezoidal component in the prior art has now been replaced in the present invention by an edge of complex shape. Thus the component which was originally trapezoidal is cut in a curved line along its short side so as to bring a portion of this edge of complex shape to a position in which it is located between the two plates of gyromagnetic material and in which is coupling zone between SEW and volume modes is formed. In other words, the edge of the core comprises a region located between the two plates of absorbing material followed by a coupling region located between the two plates of gyromagnetic material and again a region located between the two plates of absorbing material. The widths of these three regions in the direction of wave propagation will be defined hereinafter.

In more specific terms, the invention relates to a nonreciprocal microwave device for surface electromagnetic waves comprising the following components included in a magnetic field:

at least two parallel plates of gyromagnetic material in which the surface waves propagate;

at least two plates forming absorption loads for the electromagnetic waves;

a flat conductor or core placed between the gyromagnetic plates and between the absorption loads, the function of said flat conductor being to convert a volume wave which is present at the input of the device of a surface wave and to convert the surface wave to a volume wave at the output of the device;

said device being distinguished by the fact that, in order to absorb the parasitic volume waves generated by resonance and to prevent resonance of waves of higher modes, the core has at least one zone for strong coupling with the SEW mode of surface waves which proragate in reverse direction opposite to the direction of low-loss propagation, at the edge of the core opposite to the edge at which the SEW wave is propagated in the forward direction.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
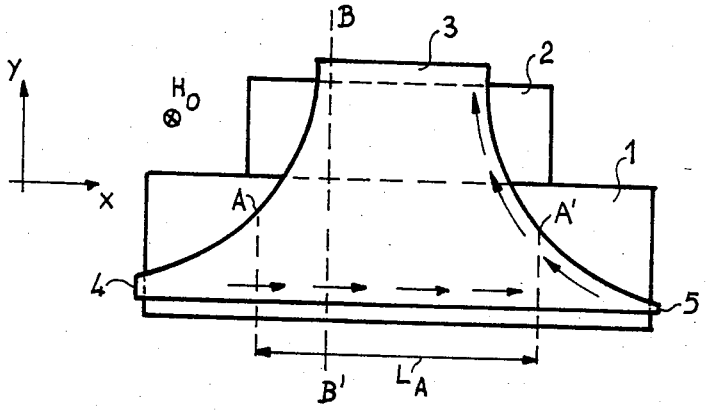
FIG 1 PRIOR ART
FIG. 1 is a plan view of a nonreciprocal surface-wave device in accordance with the prior art, this device being open so as to show its structure.

FIG. 1 is a highly schematic illustration which recalls the structure of a nonreciprocal surface-wave device in accordance with the prior art. Said device is shown in the open state and is completed by its symmetrical counterpart with respect to the plane of the figure.

The device comprises a parallelepipedal plate 1 of gyromagnetic conductive material against which is placed another parallelepipedal plate 2 of absorbing material. On these two plates is place a metallic sheet 3 of substantially trapezoidal shape, the long rectilinear side of which is in contact with the gyromagnetic material 1 and the short rectilinear side of which is in contact with (or outside) the absorbing material 2. The assembly is completed by a second conductive plate and a second absorbing plate which are symmetrical with respect to the metallic component 3 and is placed in a magnetic field $H_o$ produced by a magnet and pole-pieces (not shown in the drawings). The field $H_o$ is perpendicular to the plane of the component 3. Two input and output connectors (not shown) are connected to the ends 4 and 5 of the sheet 3.

Said device further comprises three operating zones. At the input 4 within the portion of curvilinear triangle up to the point A of the metallic sheet 3 which forms a coupling zone, the TEM-mode volume wave which is present at the input is converted to a surface wave (SEW). In the central portion between the points A and A', the parasitic volume-mode waves are absorbed by the absorption load 2. At the output 5, starting from the point A', a second coupling zone which is symmetrical with the first, reconverts the surface waves (SEW waves) to volume waves. In this nonreciprocal device, the surface modes are transmitted in the forward input-output direction along the rectilinear edge of the core 3 while the parasitic modes emerging from the output are transmitted along the curvilinear edge of the core 3 and are absorbed by the absorption load 2. The transmission of these modes is indicated schematically by arrows.

In was stated earliear that known devices of this type sustain parasitic volume modes excited by the surface or SEW mode but that no means have yet been found for systematically blocking the excitation process. These parasitic modes result in not-negligible deformations of the response curves of the "S" parameters of the isolator. In regard to insertion loss, the response curve exhibits additional absorption "bosses" in the vicinity of high frequencies, the periodicity of said bosses being dependent on the width and on the length of the ferrite plate 1. Said bosses increase with the frequency and finally present unduly high insertion losses which attain or exceed double the characteristic attenuation of the SEW mode. In regard to isolation (or attenuation in the reverse direction), this is a fundamental parameter in the case of any nonreciprocal device and the response curve exhibits substantial reductions in isolation at the same frequencies as those of insertion attenuation. Finally, the same fluctuations are again observed in the case of the standing-wave ratios.

The object of the invention is to propose a novel concept whereby surface wave devices (SEW devices) no longer sustain volume modes as well as to propose simple means for providing high-performance, wide-band and compact isolators which achieve high isolation.

In any wave-propagation volume, the mode of interest may be accompanied by undesirable modes. When the useful frequency band and the characteristics of the volume (dimensions, material) permit this possibility, the most straightforward method consist in choosing these characteristics with a view to ensuring that the volume is capable of sustaining only a single mode.

This is not the case with devices which have a very wide band and more particularly devices which operate in a SEW mode. The SEW mode exists only within the frequency band such that:

$$\omega_R > \omega,\ \mu > 0 \text{ and } \mu_{eff} = \frac{\mu^2 - K^2}{\mu} < 0$$

with:

$\omega$=angular frequency, $\omega_R$=resonance frequency $\mu$=permeability, $\mu_{eff}$=effective permeability, K=non-diagonal element of the permeability tensor.

On the other hand, if $\omega$ is such that $\mu_{eff}>0$, volume modes may exist but their appearance can take place only if an excitation process exists. In the case of SEW-mode devices, the volume modes are excitable:

either in the case of the forward wave guided by the rectilinear edge of the core, by means of defects of elements which give rise to diffracted radiation;

or in the case of the backward wave, directly by the curvilinear edge of the core.

The volume modes are therefore excitable, especially in the backward or reverse direction since it is practically impossible to construct an infinitely thin and perfectly straight core or a polycrystalline ferrite which is perfectly homogeneous and polished.

Since the volume modes exist and since their presence is certain beyond the limit of the first octave of the passband, it has become apparent that these modes can be blocked by the absorbing element which is placed along the ferrite and beneath the central core, this element being the same as that used for absorbing the power which arrives in the reverse direction (isolation effect).

However, this blocking action is only imperfect since the volume mode, when it exists, is coupled to the absorber only by means of its leakage fields, the mode being limited within the space defined on one side by the edge of the central core (so-called magnetic wall effect) and on the other side by the opposite edge of the ferrite (electrical discontinuity effect).

Figure 2:
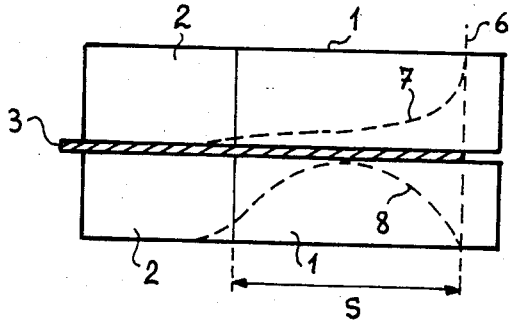
FIG. 2 is a sectional view of a nonreciprocal device showing the shape of the electric fields of the SEW surface mode and volume mode.

The view of a nonreciprocal device as illustrated in FIG. 2 is taken in cross-section along the line B—B' of FIG. 1 and also completes this latter by showing its symmetrical structure with respect to the central core 3. The ferrite components have an active width designated as S and extending between the rectilinear edge of the core and the dielectric discontinuity surface between ferrite 1 and absorber 2. The dashed line 6 represents the magnetic wall. Curve 7 defines the shape of the amplitude of the electric fields of the SEW mode while curve 8 defines the shape of the amplitude of the electric fields of the volume modes of order n=1. As will be clearly apparent, these modes are not limited in each case to one-half of the ferrite volume: the separation has been made only in order to simplify the figure.

Damping of a volume mode causes a drop in overvoltage of this latter and consequently in the proportion of energy extracted from the SEW mode.

The parasitic modes can be resonances within the active length $L_A$ of the ferrite ($L_A$=AA' in FIG. 1) as defined by:

$$L_A = m \cdot \frac{\lambda_{gn}}{2}$$

with m: number of wave half-lengths necessary to produce resonance, $\lambda_{gn}$=guided-wave length of the volume mode of order n $$\frac{2\pi}{\lambda_{gn}} = \frac{2\pi}{\lambda_{void}} \cdot \sqrt{\frac{n\pi}{s} - \omega \cdot \epsilon_f \cdot \mu_{eff}}$$

The modes are such that their wave number $k_{xn}$ is equal to $$k_{xn} = \frac{n\pi}{S}$$

S being the active width of the ferrite.

In practice, from five to ten modes excited by $TE_{01}$ and $TE_{02}$ volume modes can thus be masked but not suppressed. This results:

either in a reduction in bandwidth at acceptable performance levels;

or in a reduction in performances at a given bandwidth as compared to expectations in the SEW mode alone.

The conceptual basis of the invention consists in preventing the phenomenon of resonance of higher-order modes and therefore the appearance of substantial couplings between the energy transported by these modes.

In accordance with the invention, there is interposed in the resonator at the quasi-TE mode (that is, in the central zone of the core as described earlier) a zone providing a strong coupling with the SEW mode which propagates in the reverse direction with respect to the low-loss direction at the edge of the central core opposite to the rectilinear edge which propagates the SEW wave in the forward direction. The practical construction of this coupling zone will be explained in detail hereinafter but has the effect:

of transferring energy from the volume mode to the SEW mode;

of transporting this energy to the absorber since the coupling zone is located on that side of the core which covers the absorber.

If the coupling zone is of sufficiently large size, that is to say at least one half-wave from the SEW mode, the resonance phenomenon is made impossible.

Figure 3:
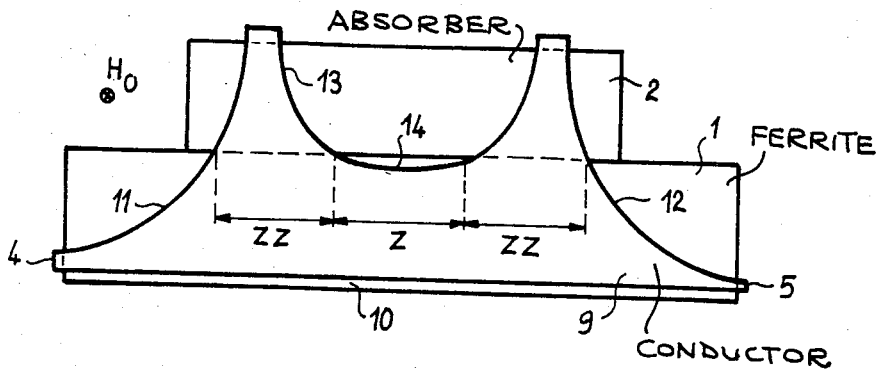
FIG. 3 is a plan view of a nonreciprocal device in accordance with the invention.

The nonreciprocal device in accordance with the invention as illustrated in FIG. 3 has a general structure which closely resembles that of known devices of the type illustrated in FIG. 1. Thus the device under consideration similarly comprises a plate 1 of gyromagnetic material such as a ferrite and a plate 2 forming an absorption load as well as a metallic core 9 which is preferably a thin sheet of copper.

Provision is naturally made for a second ferrite plate 1 and a second absorption load 2 which are disposed symmetrically with the first with respect to the metallic core 9 as shown in the cross-section of FIG. 2 and the assembly is subjected to the magnetic field $H_o$ of a magnet (not shown in the drawings).

The originality of the device in accordance with the invention arises from the geometrical shape of the conductive core 9. This core again has a shape which recalls that of a curvilinear trapezium with a long rectilinear edge 9 extending between the input 4 and the output 5 in a direction parallel to the edge of the ferrite component 1. The shape of the core is completed by two curvilinear edges 11 and 12, the convexity of which is directed towards the long rectilinear edge 10. Said curvilinear edges join respectively the input 4 and the output 5 to the absorbing load 2. But in accordance with the invention, the short rectilinear edge of the core 3 of FIG. 1 is deeply recessed to form a curvilinear edge 13, the depth of the curve being such that a portion 14 of the edge 13 is located between the two ferrite plates 1.

The coupling zone is formed precisely in the region just mentioned in which the portion 14 of the edge of the metallic core 19 is located between the ferrites 1. If the recess is not of sufficient depth and the edge 13 of the core 9 still remains between the two absorption loads 2, there is no coupling zone and no appreciable effect of suppression of volume modes.

The curvilinear edge 13 can have a simple profile which may be circular, for example, or else a profile of the second degree such as an ellipse or a parabola. Said edge could also have a more complex shape and be either symmetrical or unsymmetrical with respect to a straight line perpendicular to the long edge 10.

If the recess which forms the curvilinear edge 13 is reduced to a narrow slot, the coupling zone along the portion 14 of said edge is non-existent and there is no effect.

If Z designates the length, measured along the ferrite, of the coupling zone formed by the portion 14 of the curvilinear edge 13, the volume mode of order n is blocked as soon as:

$$Z > \frac{\lambda_{gn}}{4}$$

in practice, the value adopted will be $$Z \geqq \frac{\lambda_{gl}}{2}$$

If ZZ designates the length of the conductive core 9 at the level of the junction between ferrite 1 and absorber 2 on each side of the coupling zone of length Z, said length ZZ is preferentially:

$$ZZ > \frac{\lambda_{gl}}{2}$$

The length ZZ must be sufficiently great since it is related to the transverse attentuation of the volume mode.

The improvement achieved by the coupling zones finds its application in high-isolation devices. The isolation achieved by devices which operated in the SEW mode is a function of:

the characteristic attenuation between the two SEW modes (incident and reflected waves) which can be improved by increasing the length of the device but the amount of isolation achieved in actual practice by a length equivalent to three times the active width S of the ferrite does not exceed 30 dB in the majority of instances;

the energy transmitted by the higher modes.

One solution consists in constructing high-isolation devices in which a plurality of SEW isolators are placed in series but this has the effect of increasing the length of the device and its insertion losses at the same time as the isolation.

In accordance with the invention, it becomes possible to construct high-isolation devices comprising a plurality (two, three, four, etc.) of coupling zones in order to increase the isolation without producing a proportional increase in insertion losses.

Figure 4:
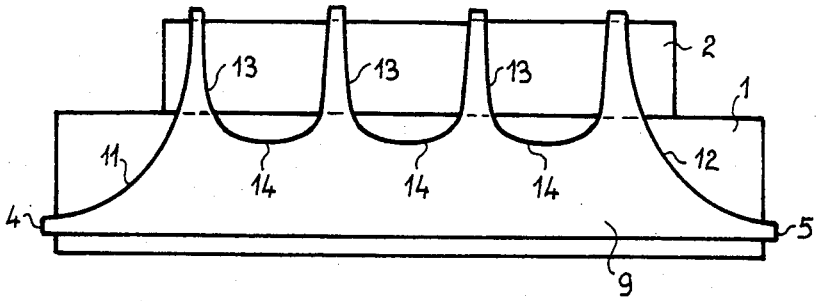
FIG. 4 is a plan view of a high-isolation isolator in accordance with the invention.
Figure 5:
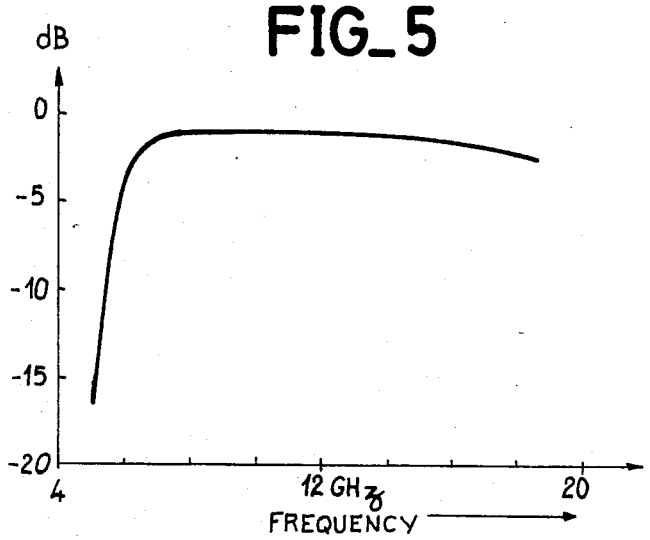
FIG. 5 shows a curve of the insertion loss of an isolator as illustrated in FIG. 3.

FIG. 4 illustrates a high-isolation isolator having a core 9 comprising three coupling zones 14 between the SEW mode and the $TE_{on}$ modes. Irrespective of the number of coupling zones which are formed in the core 9, a greater number has the effect of increasing the insertion losses of the device but not in the same proportion since the propagation length does not vary in a proportional manner. However, said insertion losses remain low as shown by the curve of FIG. 5.

This characteristic curve relates to a device having a single coupling zone such that Z=4 mm, which corresponds to $\lambda_g/2$ at about 10 GHz: this is the cuttoff frequency of the first volume mode of the measured device which operates between 6.5 and 18 GHz. The insertion losses of −1.8 dB at 6.5 GHz are uniformly comprised between −1.08 and −1.80 dB up to 17.5 GHz and do not exceed −2.05 dB at 18 GHz.

Figure 6:
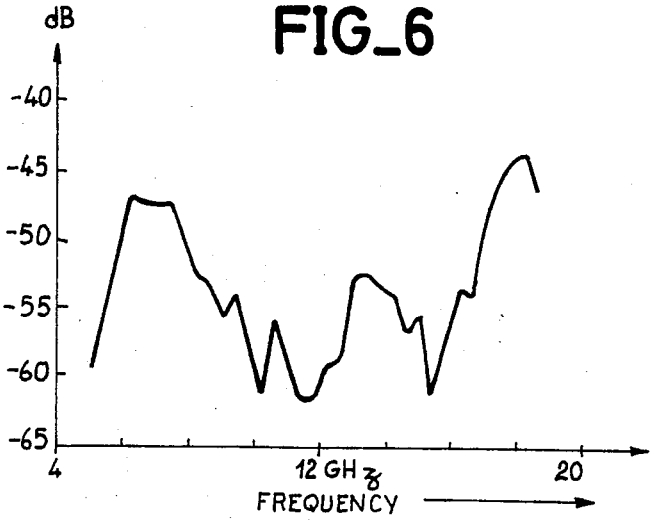
FIG. 6 shows a decoupling curve in the case of an isolator in accordance with the invention as illustrated in FIG. 3.

FIG. 6 corresponds to decoupling of the same isolator within the same frequency band. Although the curve shown is not monotonic, it always remains within the range of −46.69 dB to −61.77 dB. This represents a considerable gain in the amount of isolation which, in the device of the prior art, is of the order of −20 dB to −35 dB in respect of insertion losses which are very close in value (≦1.6 dB).

In regard to the other constituent elements of the isolator, they correspond to the descriptions given in the patents cited earlier. The ferrite plates 1 preferably consist of one-piece slabs in each case while the absorbing loads 2 can consist of one or a number of parts which may or may not be in contact with the ferrites. The wave impedance of the absorbing material is preferably close in value to that of the SEW mode. Finally, the magnet and its pole-pieces are preferably integrated in the device in order to form a packaged assembly.

The invention is applied to nonreciprocal devices providing high isolation in the microwave field.

What is claimed is:

1. A nonreciprocal microwave device for surface electromagnetic waves (SEW) comprising the following components included in a magnetic field ($H_o$):

at least two parallel plates of gyromagnetic material in which the surface waves propagate;

at least two parallel plates adjacent said gyromagnetic material forming aborsption loads for the electromagnetic waves;

a flat conductor or core placed between the gyromagnetic plates and between the absorption loads, the function of said flay conductor being to convert a volume wave (TEM wave) which is present at the input of the device to a surface wave and to convert the surface wave to a volume wave at the output of the device, wherein, in order to absorb the parasitic volume waves generated by resonance and to prevent resonance of waves of higher modes, the core is deeply recessed to form a curvilinear edge, on its portion placed between the absorption loads, the depth of the curve being such that a portion of the curvilinear edge is located between the two gyromagnetic plates, forming at least one zone for a strong coupling between the parasitic volume waves and the SEW mode of surface waves to convert the energy of the parasitic waves into surface waves which propagate in reverse directions opposite to the direction of low-loss propagation.

2. An isolator providing high isolation in accordance with claim 1 wherein said core is constituted by a plurality of strong-coupling zones.

3. A nonreciprocal microwave device according to claim 1 in which the core of said device is a flat metallic conductor comprising:

a rectilinear edge for propagating the SEW wave in the forward direction from the input to the output, said edge being located between the two gyromagnetic plates;

two curvilinear side edges located partly between the two gyromagnetic plates and partly between the two plates forming absorption loads;

wherein, in order to form said strong coupling zone, the curvilinear edge of the core is opposite to the rectilinear edge and has a curvilinear shape whose convexity is directed towards said rectilinear edge.

4. A nonreciprocal microwave device according to claim 3, wherein the curvilinear edge opposite to the rectilinear edge of the core has a circular shape.

5. A nonreciprocal microwave device according to claim 3, wherein the curvilinear edge opposite to the rectilinear edge of the core has a parabolic.

6. A nonreciprocal microwave device according to claim 3 wherein the lengths of the coupling zone and of the two portions of the core which surround said coupling zone are each greater than $\lambda_{g1}/2$, where $\lambda_{g1}$ is the wavelength of the first-order guided wave.

7. A nonreciprocal microwave device according to claim 3, wherein the curvilinear edge opposite to the rectilinear edge of the core has an elliptical shape.

* * * * *